United States Patent [19]

Bradley et al.

[11] Patent Number: 4,867,057

[45] Date of Patent: Sep. 19, 1989

[54] METHOD AND APPARATUS FOR SIMULTANEOUSLY HOT STAMPING AND EMBOSSING SHEET-LIKE STOCK MATERIAL SUCH AS PAPER

[75] Inventors: Sterling E. L. Bradley, North Olmsted, Ohio; Jimmy W. Farrow, Osceola, Ark.

[73] Assignee: American Greetings Corporation, Cleveland, Ohio

[21] Appl. No.: 111,729

[22] Filed: Oct. 21, 1987

[51] Int. Cl.[4] ..... B44C 1/14; B44B 5/00

[52] U.S. Cl. ..... 101/21; 101/32; 101/401.1; 101/31

[58] Field of Search ..... 101/27, DIG. 4, 8, 9, 101/21, 25, 31, 32, 3 R, 401.1, 28

[56] References Cited

U.S. PATENT DOCUMENTS

| | | | |
|---|---|---|---|
| 1,714,795 | 5/1929 | Luedtke et al. . | |
| 1,898,782 | 2/1933 | Littlefield . | |
| 2,005,340 | 6/1935 | Jaffin et al. | 101/28 |
| 2,339,145 | 1/1944 | Callum | 101/32 |
| 2,390,618 | 12/1945 | Roehm | 101/32 |
| 2,639,660 | 5/1953 | Sunderhauf et al. | 101/32 X |
| 2,854,336 | 9/1958 | Gutknecht | 101/28 X |
| 2,887,042 | 5/1959 | Broderick et al. | 101/28 X |
| 2,943,560 | 7/1960 | Wrob et al. . | |
| 3,022,231 | 2/1962 | Broderick | 101/28 X |
| 3,075,435 | 1/1963 | Mathews et al. . | |
| 3,166,009 | 1/1965 | Brandtjen, Jr. . | |
| 3,194,152 | 7/1965 | Rubinoff . | |
| 3,252,410 | 5/1966 | Stephenson . | |
| 3,302,558 | 2/1967 | Otto . | |
| 3,584,572 | 6/1971 | Apicella . | |
| 3,589,279 | 6/1971 | Deutsch . | |
| 3,613,570 | 10/1971 | Gladen . | |
| 3,669,014 | 6/1972 | Spaw et al. . | |
| 3,721,185 | 3/1973 | Rambausek . | |
| 3,995,958 | 12/1976 | Leawood et al. . | |
| 4,084,500 | 4/1978 | Brown et al. . | |
| 4,196,664 | 4/1980 | Crasnianski . | |
| 4,455,933 | 6/1984 | Bichsel . | |
| 4,542,691 | 9/1985 | Kokrhanek . | |
| 4,658,721 | 4/1987 | Mathis . | |

FOREIGN PATENT DOCUMENTS

| | | | |
|---|---|---|---|
| 2148191 | 5/1985 | United Kingdom | 101/32 |

*Primary Examiner*—Clifford D. Crowder

*Attorney, Agent, or Firm*—Baldwin, Egan & Fetzer

[57] ABSTRACT

Method and apparatus for simultaneously hot stamping and embossing a work sheet, such as for instance a paper work sheet, utilizing a die with a relief design thereon, and a complementary counter, and operable to cause embossment of the work sheet together with transfer of heat transferable material from an intermediate substrate, at raised areas on the die design onto the work sheet, while preventing or selectively localizing transfer of the heat transferable material on the flexible substrate to identified simultaneously formed embossed areas of the work sheet, upon closing of the die and counter against the intermediate substrate and work sheet, with predetermined pressure and temperature.

23 Claims, 11 Drawing Sheets

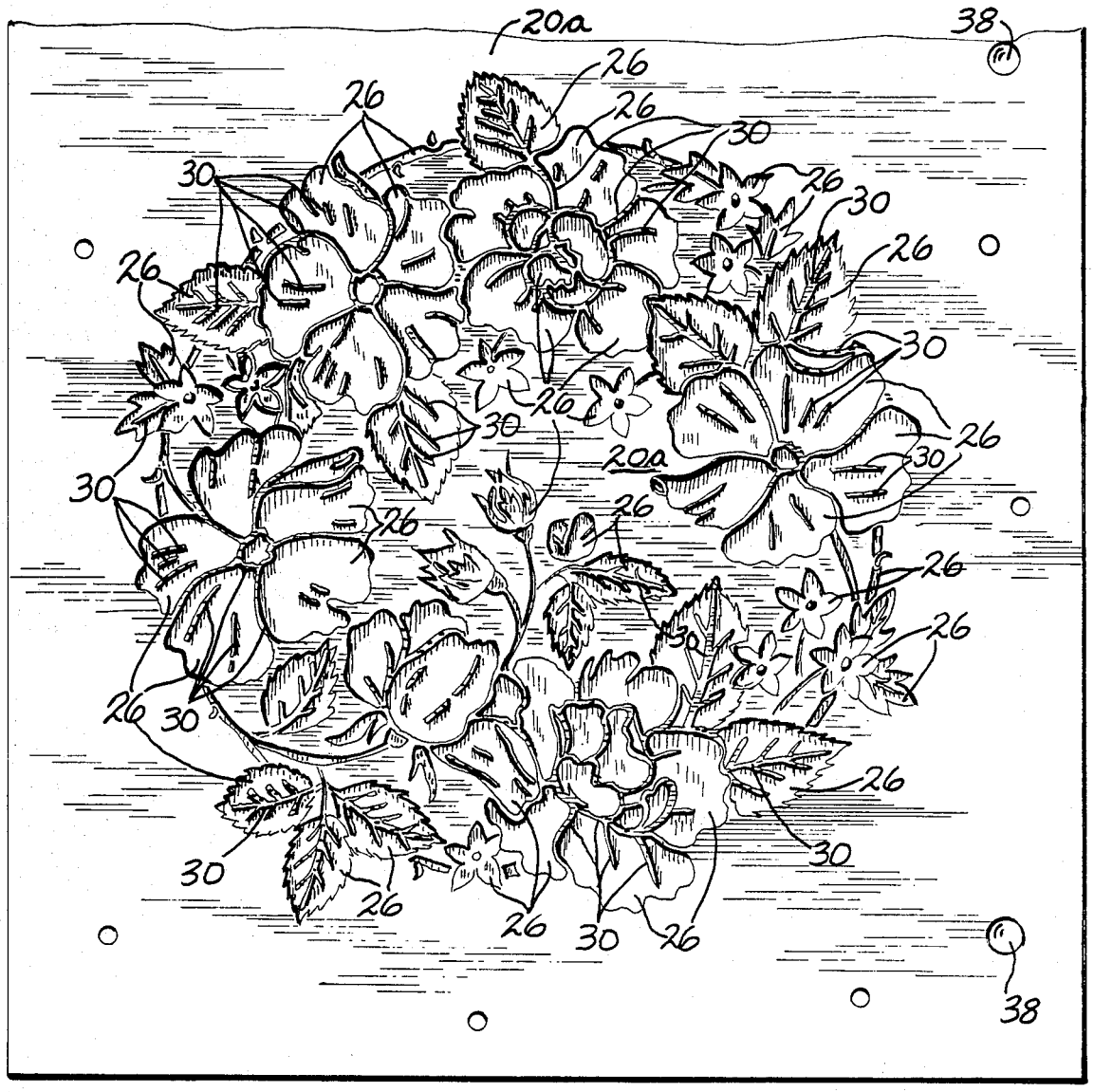
Fig 3
Fig 3a
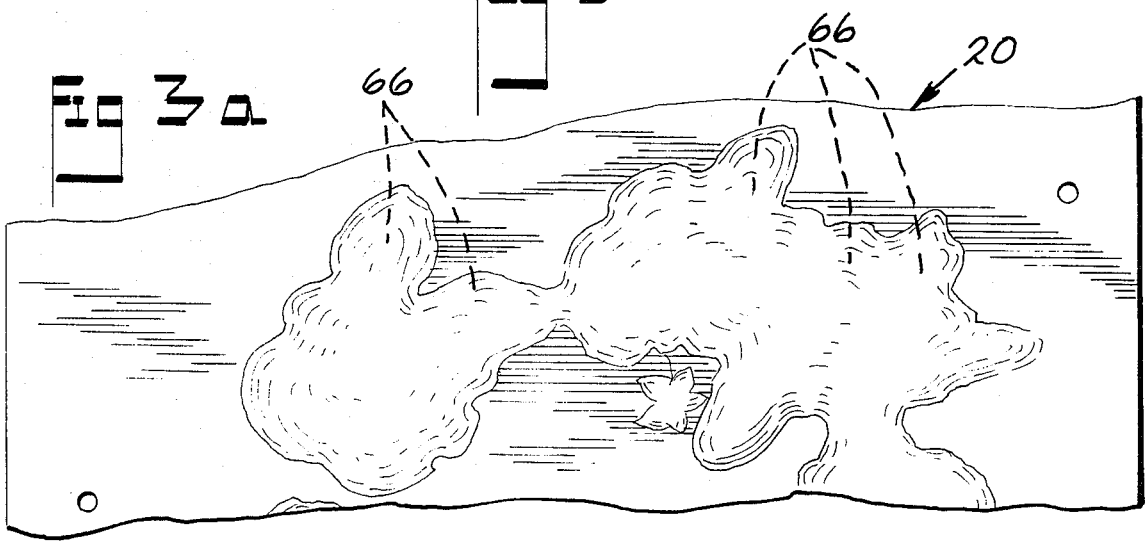

METHOD AND APPARATUS FOR SIMULTANEOUSLY HOT STAMPING AND EMBOSSING SHEET-LIKE STOCK MATERIAL SUCH AS PAPER

The present invention relates to a method and apparatus for simultaneously hot stamping and embossing a sheet of stock material, and more particularly relates to a method and apparatus for simultaneously hot stamping and embossing paper sheets in the production of greeting cards and the like, and in a manner wherein embossed areas of the card may be selectively circumscribed, delineated or otherwise enlarged by foil applied to predetermined restricted areas, to provide a pleasing, engraved appearance to the card.

BACKGROUND OF THE INVENTION

Work sheets, such as for instance greeting cards, having both embossing and hot stamping or hot foiling thereon, are well-known in the prior art. However, the embossing and hot stamping operations are generally carried out sequentially, to produce the embossed and foiled card. Such sequential type operations generally require extremely accurate registration of the work sheets with respect to the embossing die and subsequent hot stamping die, or vice versa, so that the foil transferred to the work sheet is properly positioned or aligned with respect to the embossed portions of the sheet. Accurate registration is generally somewhat difficult to obtain and substantial scrap may occur when the embossments on the work sheet are not in exact registration with the design on the hot stamping die during the hot foiling, or vice versa.

U.S. Pat. No. 3,669,014 dated June 13, 1972 in the name of Eugene S. Spaw, et al and entitled Means Including Two die Sets For Embossing And Applying Foil To A Sheet, teaches apparatus and method for sequential foil applying and embossing.

U.S. Pat. No. 3,584,572 dated June 15, 1971 in the name of Anthony Apicella and entitled Method Apparatus And Die Adapted To Simultaneously Heat Stamp, Emboss And Cut, discloses simultaneous hot stamping and embossing of a workpiece or sheet of stock material. However, such method and apparatus causes embossing and hot foiling at the same areas or locations on the work sheet. In applicant's arrangement, the hot stamping or foiling is accomplished primarily in areas adjacent to those areas on the work sheet where embossment occurs, so that the embossed areas are generally encompassed or delineated by foil areas, and in a manner whereby generally exact registration between embossed areas and encompassing foil areas is accomplished, with such embossed areas and foil areas being optimumly aligned with the artist's design previously printed on the sheet of stock material, resulting in a pleasingly appearing and high quality greeting card.

SUMMARY OF THE INVENTION

The present invention provides a method and apparatus for simultaneously hot stamping and embossing sheet-like stock material, with the apparatus comprising a die and means to transmit heat to the die, and with the die including a relief design thereon including recessed areas and adjacent raised areas and with a counter adapted for coaction with the die, the counter including projecting areas conforming in general to said recessed areas of the die, but being so constructed and arranged so as to provide a smooth embossment of the stock material. A flexible substrate having heat transferable material thereon is adapted for disposal between the die and the counter, and means are provided for supporting the die and the counter in generally confronting relationship and operable to cause relative compressive movement therebetween, for causing embossment of the design of the recessed areas of the die into intermediately disposed stock material such as paper sheet, and to cause transfer of the heat transferable material from the substrate at the die raised areas, onto the stock material, while generally preventing transfer of the heat transferable material on the substrate to identified embossed areas of the stock material.

The present invention further provides a method and apparatus which through simultaneous embossing and hot stamping operations, is capable of producing a work sheet containing embossed areas free of hot stamped material, hot stamped areas free of embossing, and selected local areas enhanced both with embossing and hot stamped material.

Accordingly, an object of the invention is to provide a novel method and apparatus for simultaneous hot stamping and embossing of sheet-like stock material, such as for instance greeting cards.

Another object of the invention is to provide a method and apparatus of the type described wherein accurate registration is obtained between foil stamped areas on the sheet-like stock material and the simultaneously embossed areas thereof, so that replications with high quality definition and very little if any scrap, occurs in the production of the sheet-like product.

A still further object of the invention is to provide a method and apparatus as aforediscussed which increases the speed of operation of embossment and hot foiling processes, by virtue of the fact that both operations are accomplished simultaneously on the workpiece.

A further object of the invention is to provide a method for simultaneously embossing and hot stamping the workpiece of sheet-like stock material by transferring heat transferable material from a substrate carrying said heat transferable material onto selected portions of the stock material workpiece simultaneously while the workpiece is undergoing embossment and precluding transfer of the heat transferable material on the substrate in selected embossed areas of the stock material.

A still further object of the invention is to provide a method of the latter discussed type wherein the compressive movement of the counter and the die relative to one another to cause compression of the stock material and the substrate therebetween is applied within a range of approximately 100 psi to 500 psi and at a temperature within the range of approximately 150° F. to 300° F.

Other objects and advantages of the invention will be apparent from the following description taken in conjunction with the accompanying drawings wherein:

BRIEF DESCRIPTION OF THE DRAWINGS

FIG. 3 is a fragmentary top plan view of a die plate produced in accordance with the invention, using for instance photographic transfer and etching techniques, and utilizable in the production of a formed malleable sheet, that in turn is utilized in producing the counter used in the apparatus of this invention;

FIG. 3*a* is a fragmentary view of the exterior of the distorted bottom wall of the FIG. 14 die plate member;

FIG. 9 is a fragmentary, front elevational view of the formed counter;

FIG. 15 is a fragmentary, sectional view illustrating the formation of the counter of FIGS. 9 and 9*a* in a press mechanism, and as aforediscussed in connection with FIG. 9*a.

DESCRIPTION OF PREFERRED EMBODIMENT AND ALTERNATE EMBODIMENT

Figure 1:
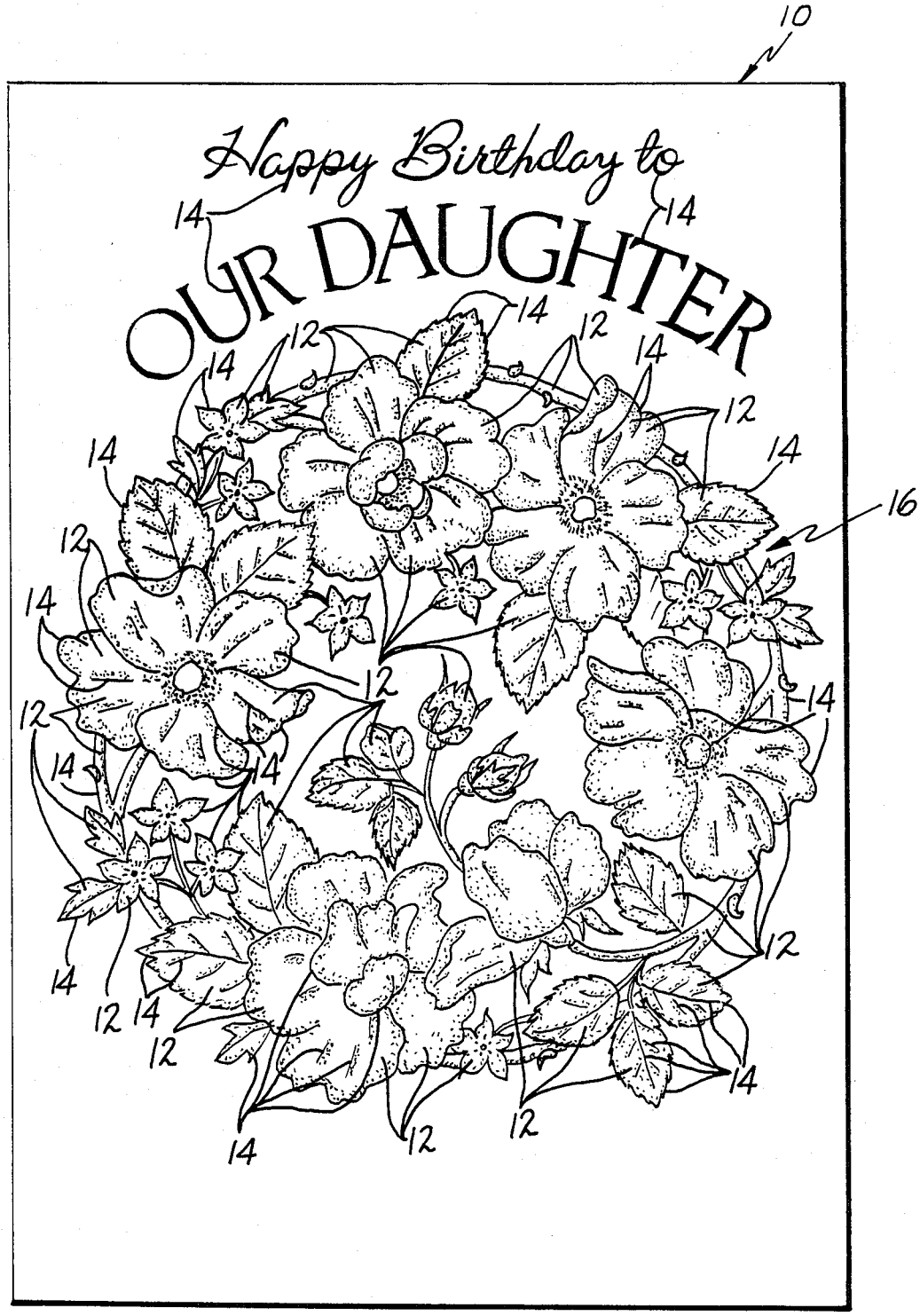
FIG. 1 is a frontal view of a workpiece (e.g. greeting card) showing embossed and heat transferred material (e.g. foiled) areas thereon (the heavy lines represent the heat transferred material) and produced by the method and apparatus of the invention.
Figure 2:
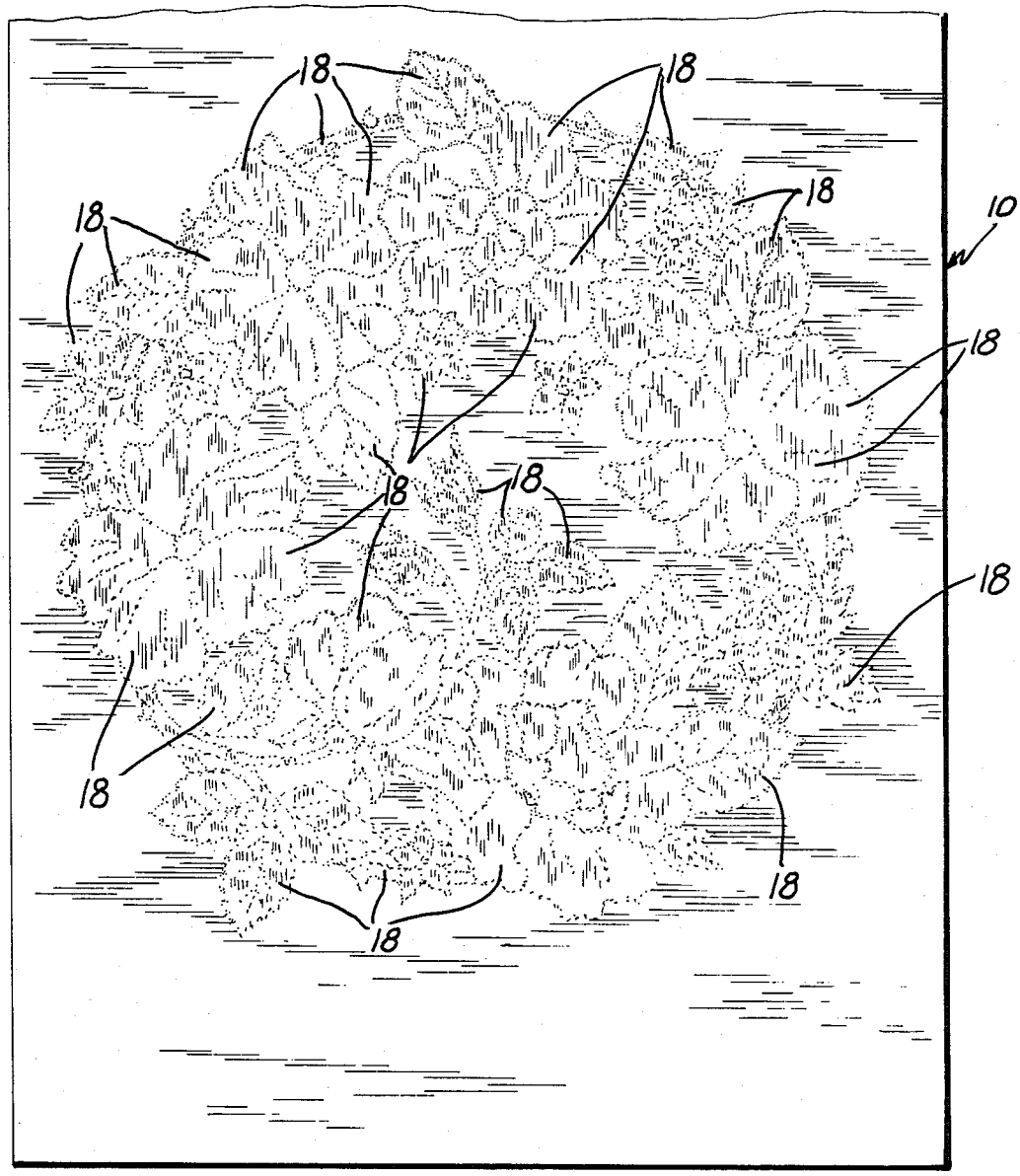
FIG. 2 is a view of the backside of the card of FIG. 1.

Referring now again to the drawings, and particularly to FIGS. 1 and 2 thereof, there is illustrated a produced end product utilizing the apparatus and method of the present invention. The product illustrated is a greeting card 10 formed of sheet stock, the frontal portion of which in the embodiment illustrated includes outwardly projecting embossed portions 12, formed out of the plane of the sheet-like material, such as paper, and with hot stamped (e.g. foiled) areas or portions 14 thereon, generally encompassing the adjacent embossed portions 12 and associated printed areas of the pictorial design 16 on the frontal surface of the card. In other words, in the FIG. 1 illustration, the heavy delineating lines in the design 16 represent heat transferred material (e.g. foil) which has been transferred to the card sheet, while the shaded areas illustrated represent the printed and embossed portions of the design. The foiled areas 14 adjacent to and generally encompassing embossed areas 12 are in exact registration therewith since they are accomplished simultaneously onto the work sheet, and thus very little if any scrap occurs in the production of the product. Also the speed of production of the product is enhanced as compared to the sequential hot stamping and embossing of the prior art.

FIG. 2 illustrates the backside of the worksheet or greeting card showing the depressions or recesses 18 formed therein, which represent the embossment of the card, registering with the project-portions 12 on the front side of the card. In other words, in FIG. 2, the vertical shading represents the recesses or female areas of the embossed design, while the horizontal shading lines represnet the back side surface of the work sheet or card 10.

Referring now to FIG. 3, there is illustrated a die plate member 20 having a design 16' thereon etched into the surface 20*a* of, in the embodiment illustrated, a $\frac{1}{8}$ inch thick copper plate, and which design is formed by utilization of conventional photographic and etching processes, well-known in the die making art, with the die plate 20 being utilized in the formation of a pattern sheet 22 (FIG. 6) which when formed into the desired mold configuration, is used to form or cast the counter 24 (FIGS. 9 and 9*a*) of the apparatus utilized in this process to produce the embossed and hot stamped product of the type illustrated in FIGS. 1 and 2, and as will be hereinafter described in detail.

It will be noted that die plate 20 (FIG. 3) has recessed areas 26 formed into the surface 20*a* of the die plate, and raised areas 30 formed from surface 20*a*, and in conjunction with recess areas 26 defining the design on the die plate. While the design 16' in die plate 20 is similar to the design on the produced greeting card 10 (FIGS. 1 and 2) it does not possess the detail that exists in design 16 and particularly does not possess the raised portions of the relief design encompassing the recessed areas, and as will be hereinafter described in connection with FIG. 8.

Aforementioned U.S. Pat. No. 3,669,014 describes in some detail photographic technology that may be utilized in the etching of a selected design into a die plate, and the teachings of such patent concerning such etching technology are incorporated herein by reference.

Figure 4:
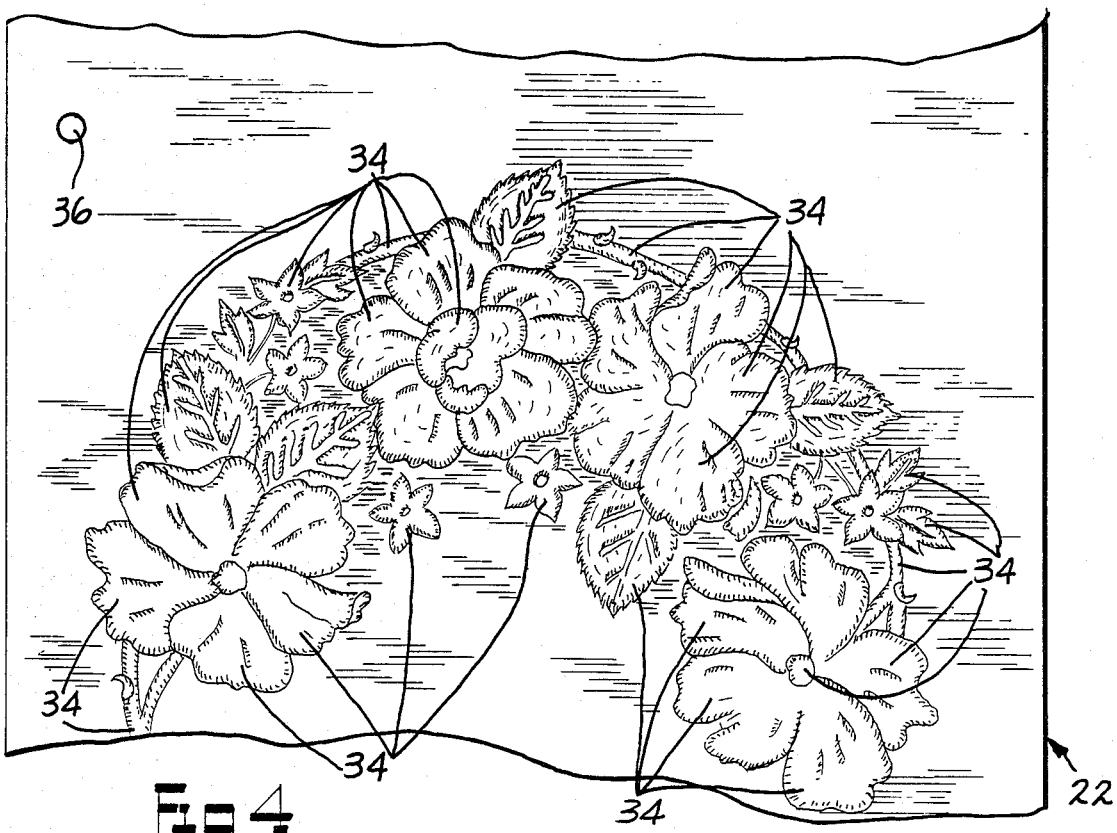
FIG. 4 is a fragmentary frontal view of the aforementioned formed sheet produced on the die plate of FIG. 3 (the male or projecting side of the sheet is shown)
Figure 5:
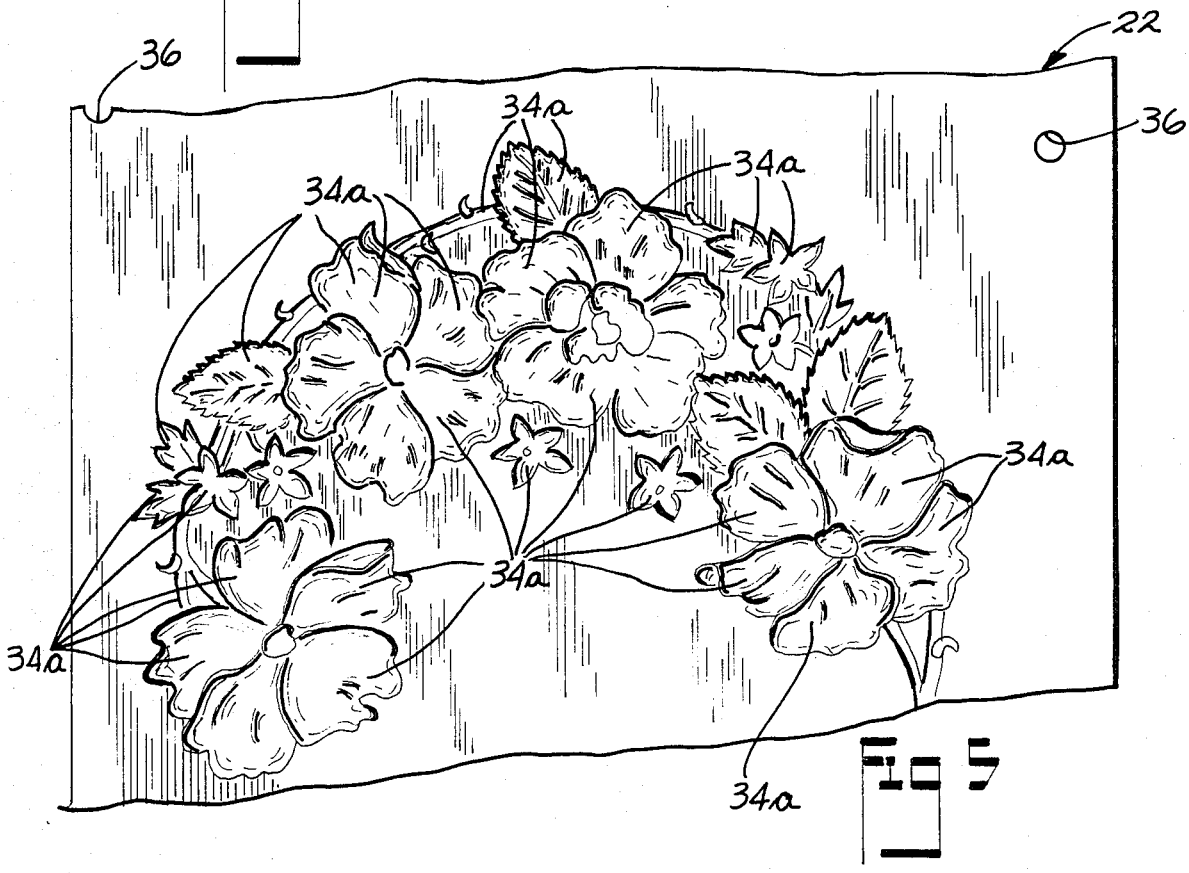
FIG. 5 is a fragmentary rear view of the formed sheet of FIG. 4, showing the female side thereof.
Figure 6:
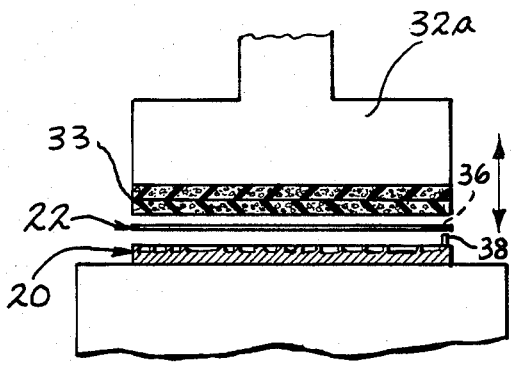
FIG. 6 is a diagrammatic illustration showing the formation of the sheet of FIGS. 4 and 5 in a press utilizing the die plate of FIG. 3 and a resilient pad, for deforming the malleable sheet into the configuration illustrated in FIGS. 4 and 5.
Figure 7:
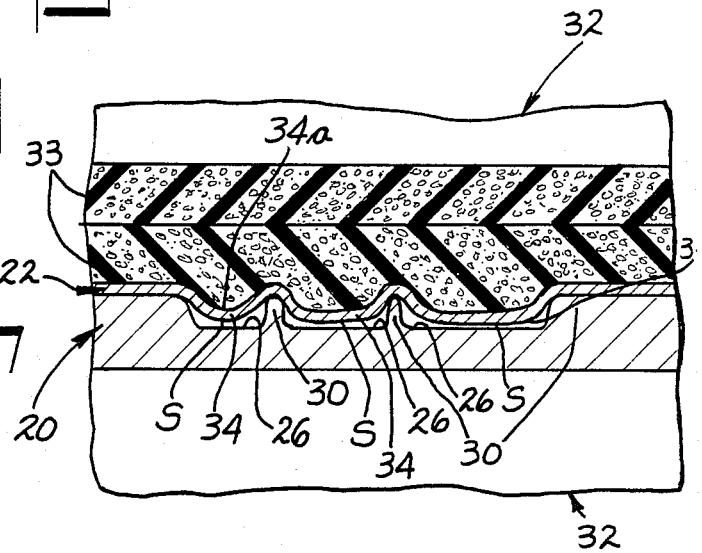
FIG. 7 is an enlarged, sectional view taken from FIG. 6, showing the resilient pad on the press deforming the pattern sheet into the recesses of the die plate.

Referring now to FIG. 6, the aforementioned pattern sheet 22 which is to be formed into a mold for formation of the counter 24 utilizing the die plate 20 of FIG. 3, comprises, in the embodiment illustrated, a flexible or malleable sheet of a thickness of, for instance, 0.005 of an inch. Such sheet 22, when it is applied at room temperature in a press 32 as illustrated in FIG. 6, with the movable portion 32*a* of the press including a resilient section 33, which enables resilient forcing of the malleable sheet 22 against the design 16' formed in die plate 20, causes the malleable sheet 22 to be deformed into the recessed areas 26 in the die plate 20, thus forming projections 34 on one side (FIG. 4) of the formed pattern sheet 22 and recessed portions or areas 34*a* on the opposite side (FIG. 5) thereof, with the raised areas 30 on die plate 20 design engaging the pattern sheet, as shown in FIG. 7. The amount of pressure applied by the press 32 to the pattern sheet 22 will determine the extent of the projections 34 on the pattern sheet. A suitable force to be applied to a pattern sheet and coacting die plate of the type aforedescribed has been found to be approximately 475 psi, with the rubber or resilient member 33 of the press being preferably formed of two layers of $\frac{3}{8}$ inch thick per layer, black sponge rubber of medium density. While spong rubber preferred, a resilient member 33 could be formed of other suitable resilient material, such as for instance a $\frac{1}{2}$ inch thick pad of synthetic rubber having a Shore durometer of, for instance, approximately 60.

The sheet 22 utilized in the embodiment illustrated is a sheet of pure copper foil of about 0.005 of an inch in thickness, and the pressure applied by press 32 to the sheet and against the die 20, is about 475 psi as aforementioned, whereby the resilient rubber material in layer 33 is forced, as illustrated, into the recessed portions 26 in the die plate 20, which thus deforms the sheet 22 at the recessed areas and forms the mold for the subsequently produced counter, as will be hereinafter described. It will be noted from FIG. 7 that the application of the pressure by the press to the resilient layer 33 and thence to the pattern sheet 22 is such that the sheet during deformation thereof does not "bottom out" in the recesses 26 in die plate 20. Instead, the sheet is deformed generally smoothly into the recessed areas 26 intermediate the projecting or tower areas 30 of the die plate 20 design in generally smooth contoured projections 34 on the formed sheet 22. The press pressure is chosen so that the spacing S between the projections 34 on the sheet 22 and the bottom surface of the recesses 26 in the die plate are preferably in the order of approximately 0.015 of an inch.

Figure 9A:
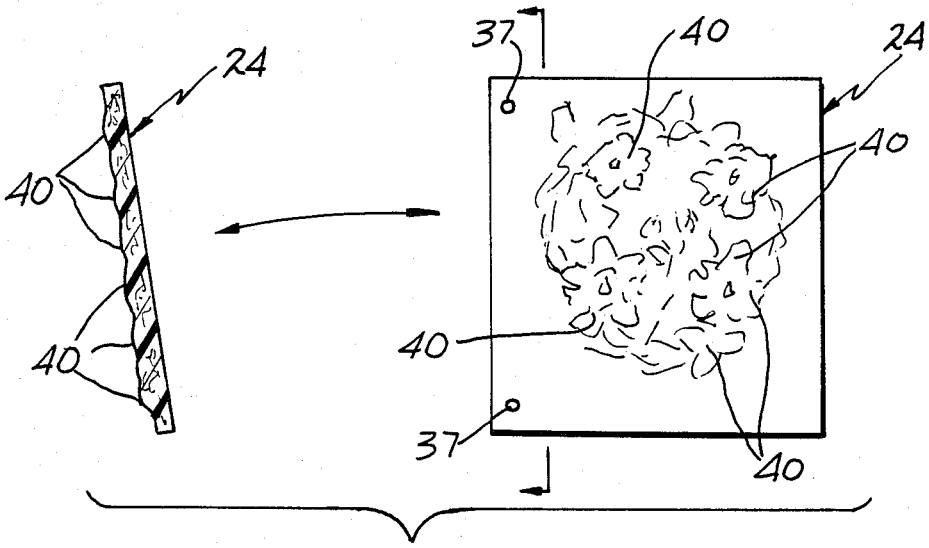
FIG. 9*a* is a diagrammatic reduced size frontal view of the counter of FIG. 9 and a diagrammatic sectional view therethrough, as produced on a press by pressing a moldable resinous material into the produced design in the formed sheet of FIG. 5, to form the resinous material into a counter.
Figure 15:
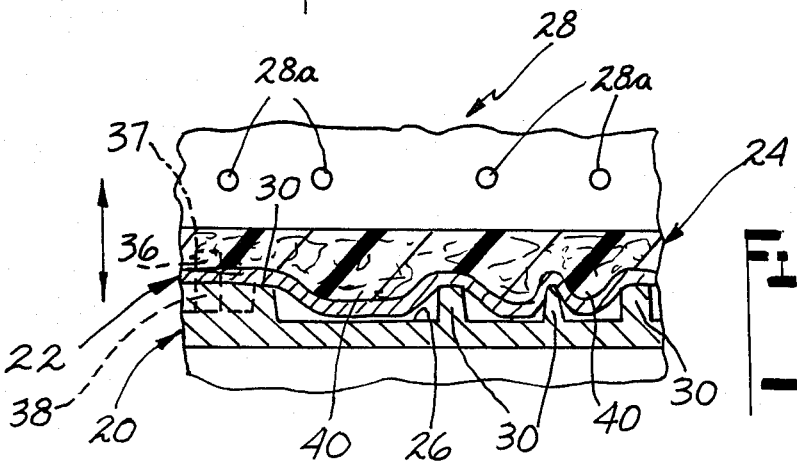

Referring now to FIGS. 9 and 9*a*, there is illustrated the counter member 24, which is formed from the configured or formed pattern sheet 22 as produced by the method described in conjunction with FIGS. 6 and 7. FIG. 15 illustrates the actual formation of a counter 24, utilizing a formed pattern sheet 22 as supported on the underlying die plate 20 in a press 28, having heating means 28*a* of any suitable type (e.g. electrical) associated therewith. Suitable controls of well-known type may be provided for selectively controlling the temperature of heating means 28*a*.

The pattern sheet 22 preferably has locating openings 36 in certain of the margins thereof, which are adapted to receive preferably removable locating pins 38 (FIGS. 3 and 15) projecting upwardly from the die plate 20, for positioning the pattern sheet 22 relative to the die plate 20. During formation of the counter 24, pins 38 may also form locating openings 37 in the counter (FIG. 15) as shown, for aligning the counter with the die plate.

The material for forming the counter may be of any suitable type and may be, for instance, a commercially available product known as "Prolam" manufactured by U.S. Prolam Inc. of Stamford, Connecticut 16904. "Prolam" is a preimpregnated glass filled thermosetting, resinous mat. When heat is applied thereto by press 28, the mat softens and under a pressure of less than 475 psi, the resinous mat is accurately conformed to the female design in the upper surface of the formed pattern sheet 22, thus forming the counter 24 and projecting portions 40 thereof, which are replicas of the female side of the formed pattern sheet 22.

The reason that the pressure applied to the resinous mat in the example discussed is no greater than 475 psi, is because further deformation of the formed pattern sheet 22 is not desired, and on the contrary, the desired configuration of the counter is that which is produced in the FIGS. 6 and 7 process for the production of the pattern sheet 22.

The press is then opened, and upon cooling, the produced counter 24 provides a generally rigid thermoset member which may be utilized in the production of the end product or greeting card, of the general type shown for instance in FIGS. 1 and 2. While "Prolam" (a heat and pressure moldable, preimpregnated pad material) has been described, other suitable materials and methods could be used to produce the counter utilizing the formed pattern sheet 22, such as for instance by using liquid casting resins where no pressure is required to conform the resin to the pattern sheet design.

Figure 8:
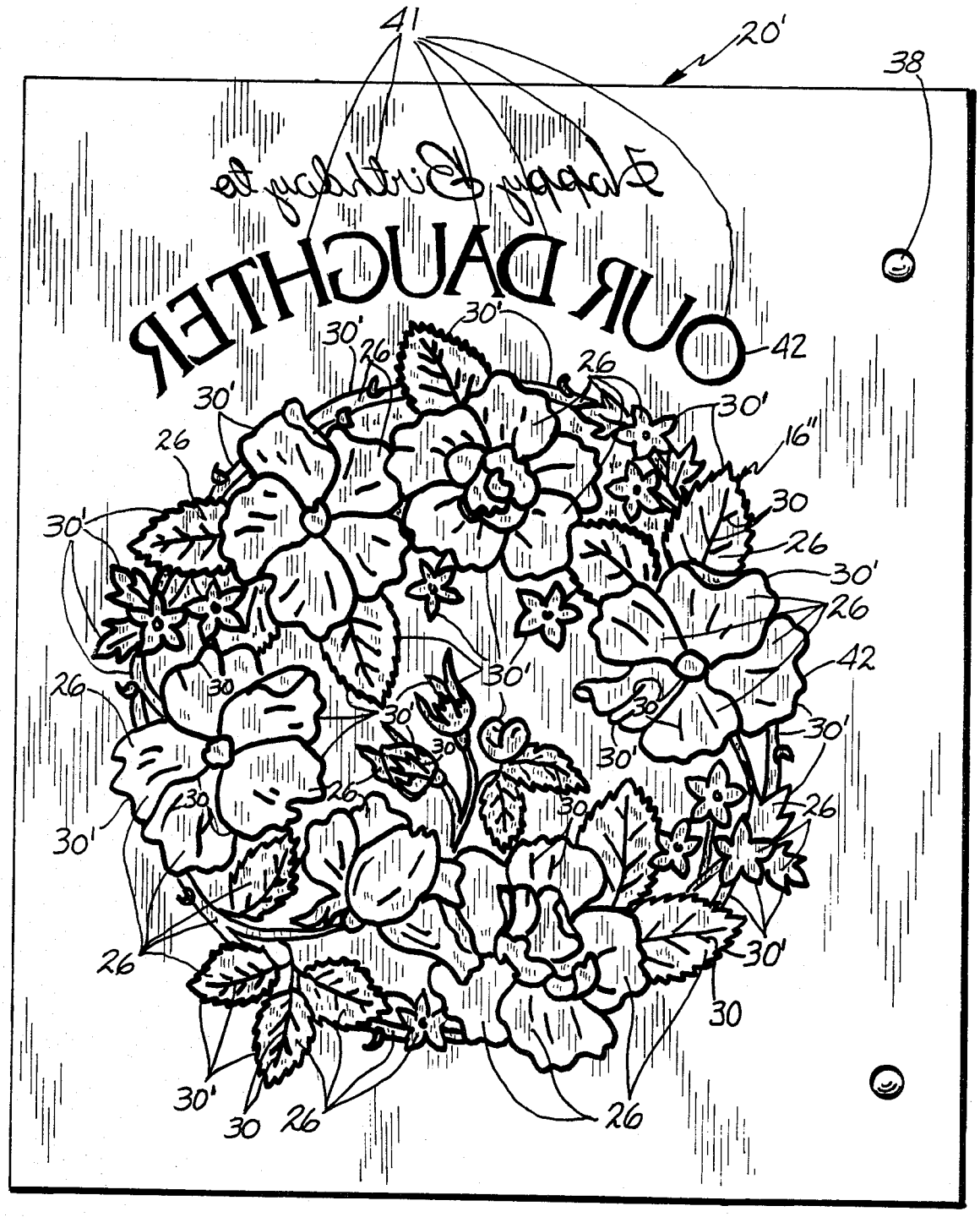
FIG. 8 is a top plan view of a die plate similar to that of FIG. 3 but after further etching thereon to finalize the relief design applied thereto, for production of the greeting card product illustrated in FIGS. 1 and 2.
Figure 7:
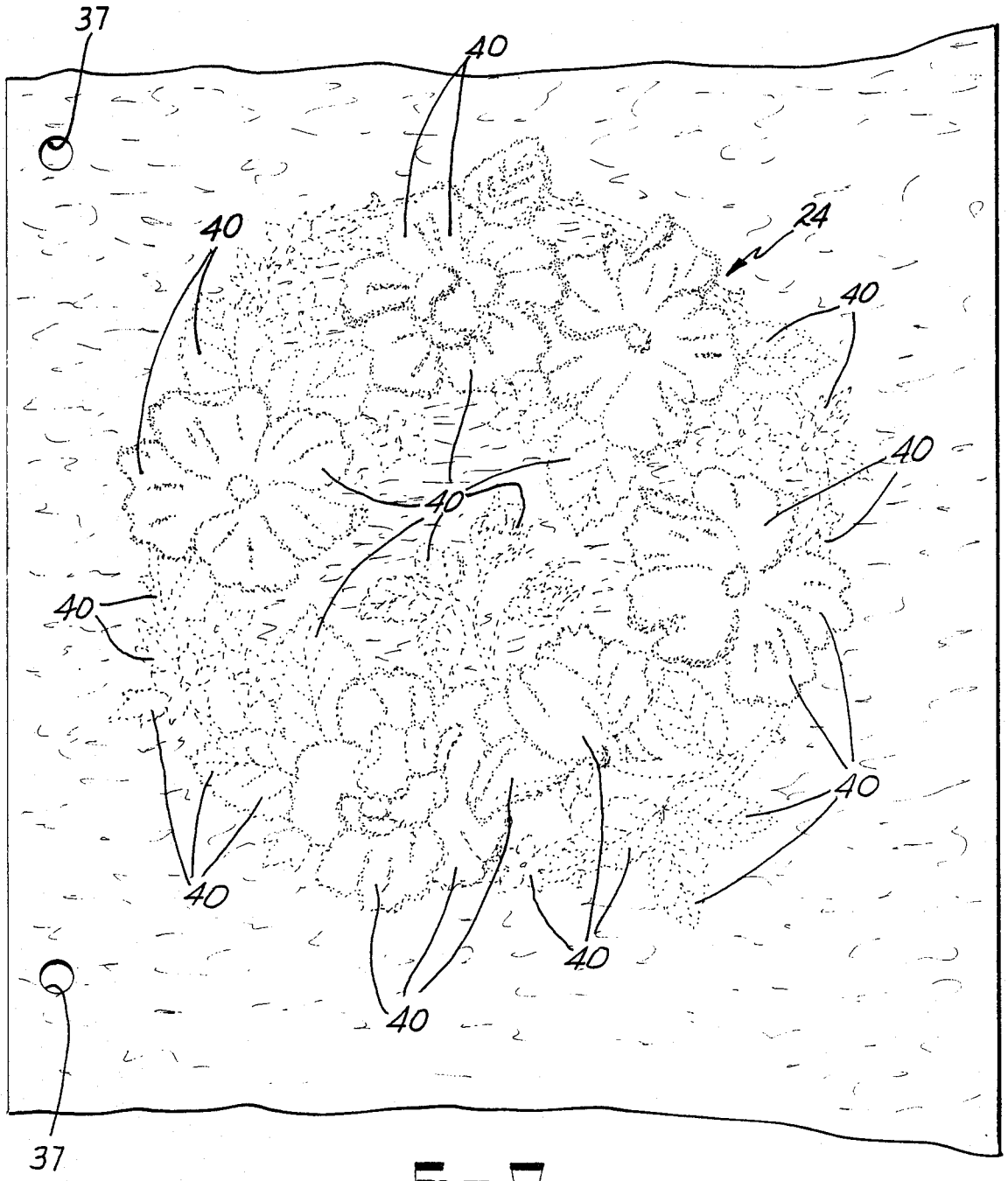

Referring now to FIG. 8, there is illustrated a top plan view of a finalized die 20' which is utilized in the production of the desired hot stamped and embossed product. The design 16'' in the plate of die 20' is provided by further photographic transfer and etching of the design, either utilizing the previous die plate 20 and further etching it, or by producing a completely new die plate using known photographic transfer and etching processes. The difference in the formed design in dies 20 and 20' is essentially that more detail of the artist's design is provided in die 20' especially as concerns the raised word areas 41 thereon, and the outlining or encompassing of the recessed embossing areas 26 of the die design by the raised areas or projection portions 30' of the design 16''. The heavy black lines represent raised areas or surfaces of the design, while the vertical shading represents recessed areas in the die plate including the die design recessed areas 26 and the recessed areas surrounding raised word areas 41. In the embodiment illustrated and in the process described, the etching of the recessed areas of the design into the die plate 20' may be approximately 0.070 of an inch in depth, measuring from the uppermost surface 42 of the die plate down to the bottommost defining surface of the recessed areas.

Figure 10:
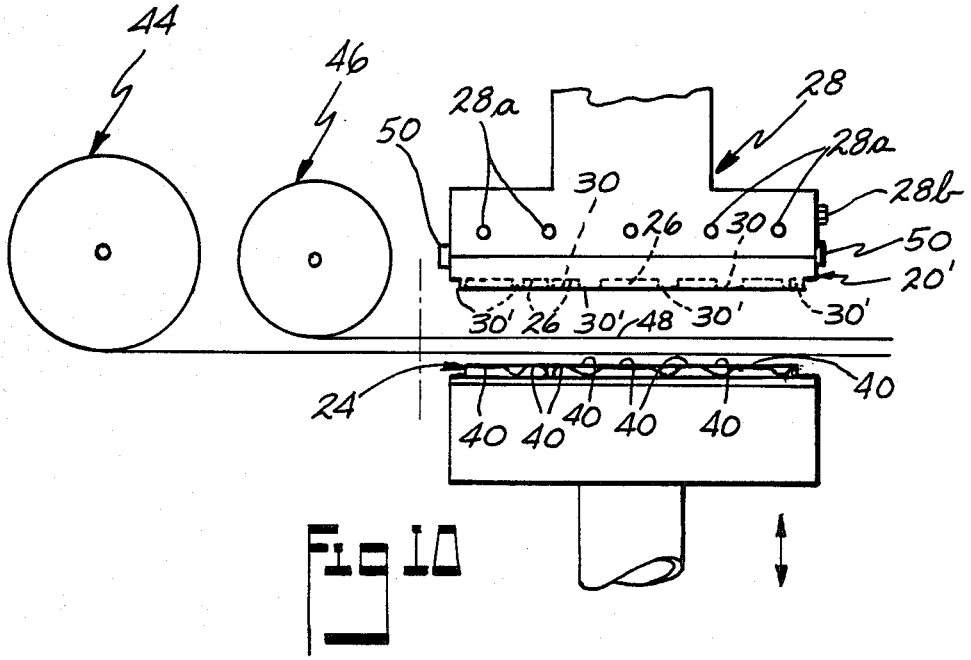
FIG. 10 is a diagrammatic side elevational view showing the die plate of FIG. 8, and the counter of FIG. 9 and 9*a*, mounted in a press, with paper stock material and a roll of heat transferable (e.g. foil) material being arranged so as to be disposed intermediate the counter and die plate, preparatory to formation of the greeting card product of FIGS. 1 and 2.

Referring now to FIG. 10, there is illustrated diagrammatically, apparatus for the production of the desired hot stamped and embossed product, utilizing the counter of FIGS. 9 and 9*a*, with the die plate of FIG. 8, in press 28, with stock material 44 such as for instance paper, and heat transferable material 46, such as metallic foil, disposed intermediate the counter 24 and the finished die plate 20', for simultaneous embossing and hot stamping (or hot foiling) of the stock material.

The press used in the process of FIG. 10 may be Bopst type press manufactured in Switzerland. A Bopst press is a hot stamp press, and Model BMA102 thereof has been found to be particularly satisfactory for performing the process to be hereinafter described. The heat transferable material may be disposed in rotatable roll form as shown, .for continuous feeding therefrom, during operation of the press and production of the end product (e.g. greeting cards). The stock material (e.g. paper sheet) illustrated in FIG. 10 may likewise be disposed in rotatable roll form as shown, and is adapted to be fed between the die 20' and the counter 24 with the aforementioned heat transferable material 46. Paper stock material for greeting card purposes is preferably of 0.010 to 0.012 of an inch in thickness, and a press pressure in the range of between approximately 100 to 500 psi may be and preferably is utilized to cause embossed transfer of the design on the die 20' to the paper, together with transfer of metallic foil material from the foil web 48 to the paper stock at the desired areas in the die plate design. While continuous rolls of stock material and foil have bee illustrated, it will be understood that the latter could also be fed to the press in individual sheet form, and as is well-known in the art.

The foil web 48 may suitably comprise a film of "Mylar" polyester, or cellophane carrier, having a coating of pigment vacuum deposited or otherwise formed on one side thereof. A release agent is applied between the carrier and the pigment to enable ready release of the coating when suitable temperature under pressure is applied by the die and counter combination 20', 24.

A pressure range of between 100 to 500 psi of pressure which may be applied by the press in order to emboss the design in die plate 20' into the paper stock material, and cause transfer of the foil or other heat transferable pigment to the paper, is considerably less than that which would be required for dry engraving of a greeting card wherein metal male and female dies are utilized for embossing or forming a design into the paper. The embossed areas 12 formed in the paper stock utilizing the apparatus and process of this invention are "softly" raised areas produced by the projecting portions 40 on the counter 24 entering the recessed areas 26 in the design 16'' of the die plate 20'.

Figure 11:
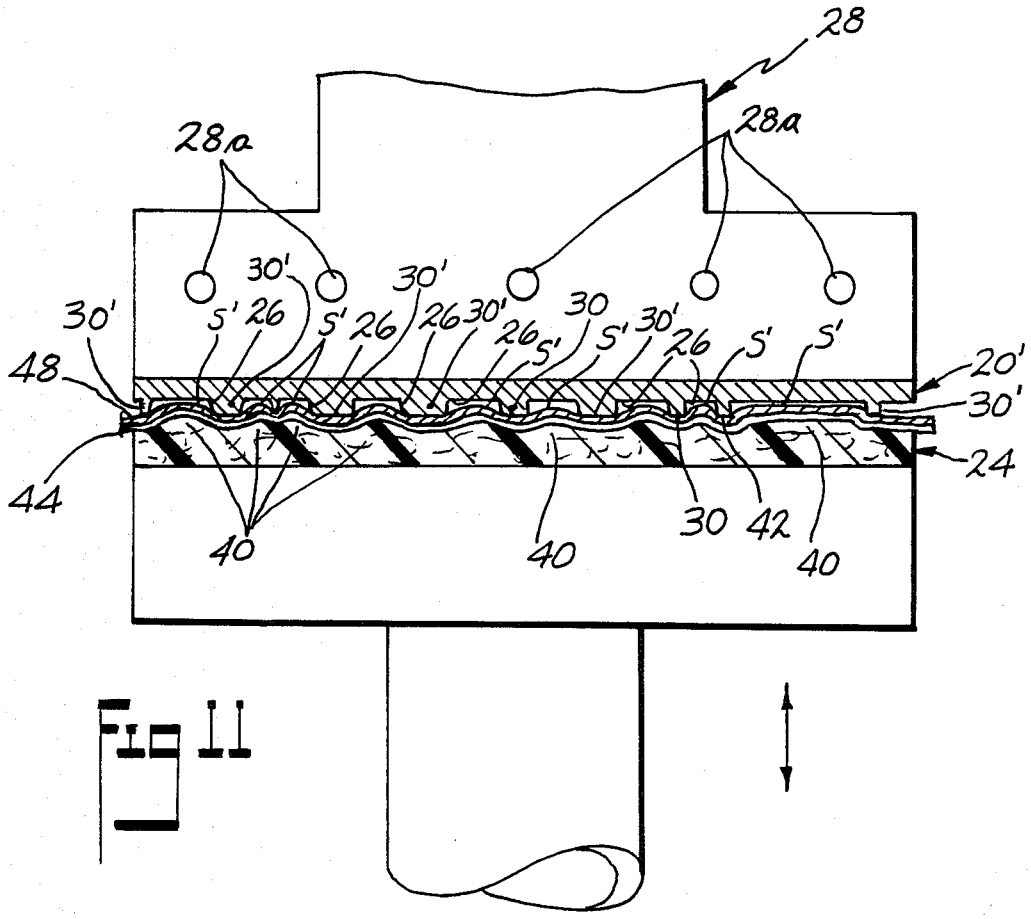
FIG. 11 is an enlarged, sectional view taken from FIG. 10, showing the closing movement of the die plate and the counter, to cause simultaneous embossment and hot stamping of the stock material, with the hot stamping generally occurring in areas encompassing the areas of embossment on the stock material, and in registration therewith.

Referring to FIG. 11 which is a diagrammatic, enlarged sectional view of the FIG. 10 press with the counter and coacting die 20', in the "closed" condition, it will be seen that the projecting or male portions 40 of the counter do not force the paper material to "bottom out" in the recessed areas 26 of the die plate 20', but instead only forces the paper in generally soft and smoothly curved projecting portions to enter the respective recessed areas 26, and always with a certain amount of spacing S' (preferably about 0.005 of an inch) between the vertically confronting surfaces of the recessed areas and the embossed portions on the paper.

The heat provided by heating means **28*a* in the press and the pressure applied to the paper 44 and to the foil web 48 is adequate to cause transfer of the foil or other heat transferable material on the web to the paper at the downwardly projecting or raised portions or areas 30, 30', 41 of the design 16'' in the die plate 20' (see FIG. 8), thus causing transfer of the foil or the pigment, to the paper at such areas. However, no transfer of the heat transferable material occurs at the embossed areas 12** of the product.

In the press illustrated in FIGS. 10 and 11, the bottom platen is the moveable section of the press, while the upper platen of the press is a relatively stationary portion, so that the counter 24 is thus moved upwardly against the overlying die plate 20' which is preferably detachable mounted by any suitable means, such as catches 50, on the underside of the upper platen of the press.

The temperature at which transfer of the foil or other pigment from the "Mylar" polyester or cellophane substrate will occur to the paper stock material varies of course, depending upon the type of foil or pigment involved, but for metal foils of the type used in greeting card production, a temperature in the range of about 175° F. to 200° F. is generally conventional. There are numerous other types of pigments or materials transferable from a substrate to paper and utilizable in the production of greeting cards and the like, such as for instance pearlescent materials, plastic pigments, shading pigments, etc., each of which has its own particular range of temperatures that are required to cause, in conjunction with pressure, the transfer of such material from a substrate to the stock material. Accordingly, the capability for a temperature range of the press heating means from about 150° F. to 300° F. is desirable, with suitable and conventional control means **28*b* (FIG. 10**) being preferably provided on the press for selecting a desired operating temperature for the press to accomplish the transfer of the heat transferable material to the stock material in the areas desired in the design.

Upon opening of the press 28, the embossed and hot stamped (hot foiled) paper stock material may then be removed from the press for further processing or handling.

Since the embossing of the paper stock material and the hot stamping thereof takes place simultaneously in the press, it will be seen that there is no alignment problem for the hot stamping areas and the embossed areas on the produced product.

Figure 16:
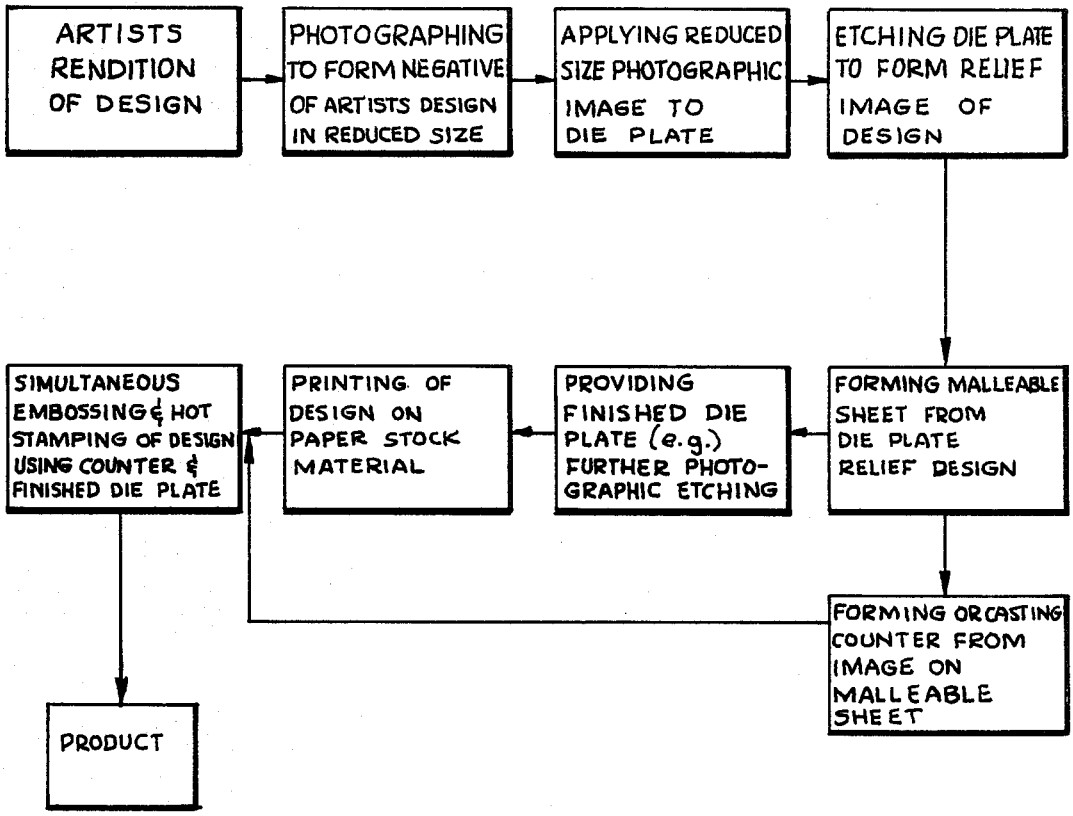
* and FIG. 16 is a flow sheet illustrating various of the steps in preparing the counter and coacting die plate in the process of producing the desired simultaneously embossed and hot stamped end product (e.g. a greeting card of the type of FIGS. 1 and 2).

Referring again to FIG. 1 in conjunction with FIG. 16, it will be seen that in the process described and in the product produced, the hot stamping in the design 16 occurs in the areas 14 circumscribing or delineating the embossed areas 12 of the produced product, with such hot stamping being in the exact desired registry with the embossed areas on the product. Since the stock material (e.g. paper sheet) when it arrives at the work station of FIGS. 10 and 11 for the embossing and hot stamping operation preferably has been previously printed with inked or colored pigment sections representing the picture of the design produced on the card (which in the product illustrated is represented for instance by the petals of the flowers, the leaves and buds, and encircling branch wreath) the alignment of such printed design on the stock material 44, with the design 16'' on the coacting die plate and counter 20', 24, is required, so that the embossment and hot stamping of the stock material occurs in the desired locations on the printed design on the stock material, or in other words, on the petals, leaves, buds, and branch wreath of the printed design, with the hot stamping occurring along the peripheries of such embossed areas and the peripheries of the components of such printed design.

Such "registering" of the printed design on the work sheet and the relief design on the die is accomplished by conventional means, many of which are known in the printing art, for registering paper stock material with a die that is to perform some operation on such stock material. For instance, the sheet of stock material may have openings therein adapted to be aligned with aligning pins (e.g. 38) on the die plate which are so positioned so as to be received into the aforesaid openings 37 in the counter, for positively aligning the counter with the die plate during closing of the press, and thus aligning the paper stock material with the die and counter during the production of the greeting card product 10.

In connection with the production of the finalized embossing and hot stamping die 20', in order to compensate for distortion of the paper stock material when it is embossed or forced into die cavity or recessed areas 26 by the counter 24 in the FIGS. 10 and 11 production process, when the die is produced by the photographic image process the photographic negative of the artist's rendition of the design is reduced in size preferably in a range of approximately 1% to 2% prior to transfer of the image to the die plate for etching. Accordingly, the design as produced on the embossing and hot stamping die plate is slightly smaller than the design of the artistic rendition produced by the artist. Thus when the printed design (which is full size) as printed on the paper stock material (FIG. 16)is embossed by the die plate and associated counter in the FIGS. 10 and 11 process, this inward distortion of the paper due to the embossment of the paper is compensated for by the reduced size of the relief design on the die plate and on the coacting counter, and the application of the hot foiling to the paper occurs substantially precisely at the peripheral edges of the embossed printed design and the embossed areas of the stock material.

Figure 12:
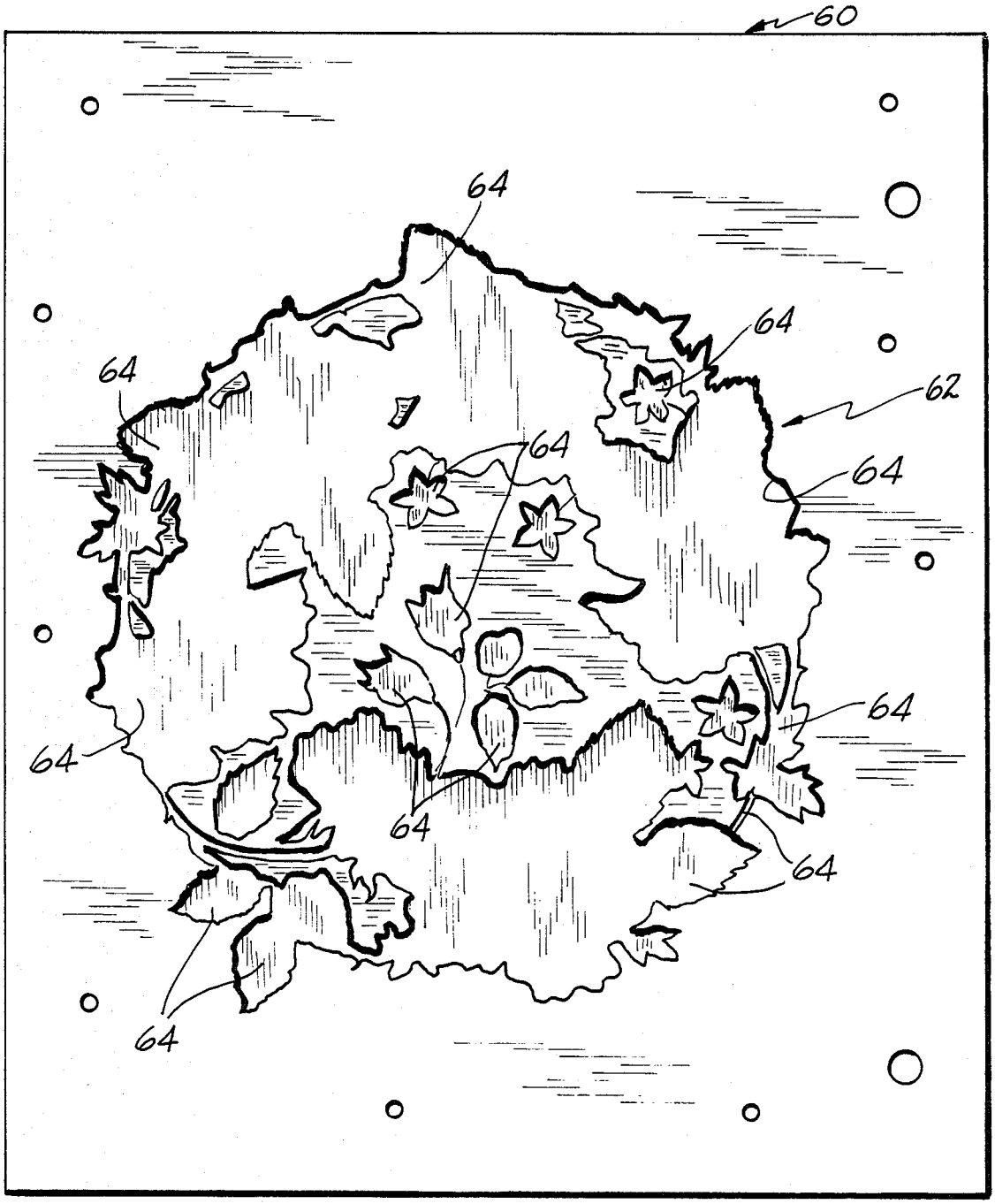
FIG. 12 is a top plan view of a further die plate made for use in producing a modified form of the die plate of the FIG. 8 illustration, with the FIG. 12 die plate configuration being likewise formed by photographic transfer and etching.
Figure 13:
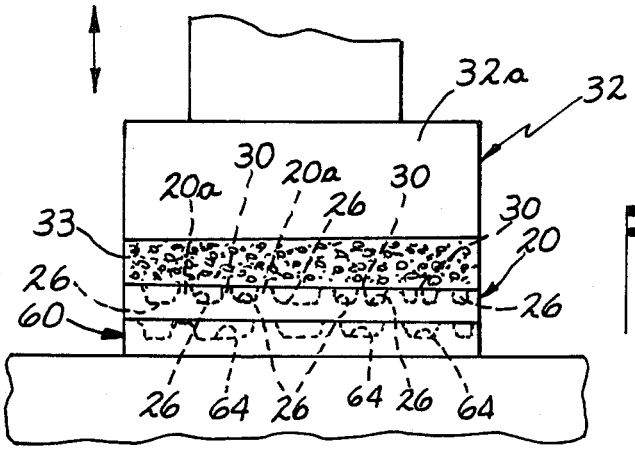
FIG. 13 is a generally diagrammatic, side elevational view illustrating a die plate similar to that of FIG. 3 positioned on the die plate of FIG. 12, with pressure being then applied thereto via a resilient pad member on the press mechanism, for causing distortion of the bottom wall sections of the recessed areas of the design on the die plate, to form a modified die plate for production of greeting cards or the like having deeper and multilevel embossments formed thereon, and as compared to the FIG. 3 and FIG. 8 die plate embodiment.
Figure 14:
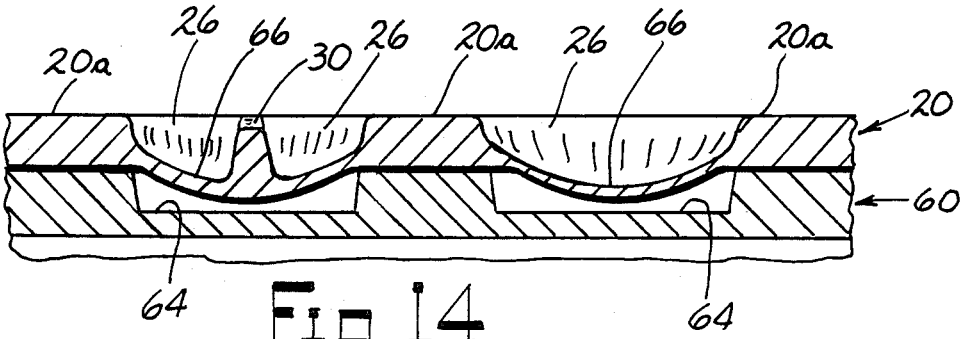
FIG. 14 is an enlarged, fragmentary sectional view taken from the distorted bottom die plate embodiment produced on the apparatus of FIG. 13, and illustrating in detail distorted areas of the bottom wall sections of recess areas in the modified die plate.

Referring now to FIGS. 12 through 14, there is shown a modified arrangement of the embossing and hot stamping die plate utilized to produce the finalized product. In this embodiment, a die plate 60 (FIG. 12) is first produced utilizing the conventional photographic negative process with the die plate thus having a relief design 62 produced thereon and wherein the etching of the design removes the entire petal, leaf, bud and wreath areas of the design, so that there are substantial recessed areas 64 in the design, without the details of the die plate designs of aforedescribed FIG. 3 and FIG. 8. Also the recessed areas 64 of this die plate 60 are of greater depth as compared to the recessed areas of the design in the die plate of FIG. 3 or FIG. 8. For instance, the depth of the recessed areas of die plate 60 may be about 0.012 of an inch.

A die plate 20 of the type illustrated in FIG. 3 may be mounted upon the modified die plate 60 of the type illustrated in FIG. 12, and is placed in a press of the type aforediscussed in connection with FIG. 6; and pressure is applied via the press to the die plate member 20 and in the range of approximately 2800 psi to 3000 psi. Such pressure application to die plate 20 causes deformation of the bottom defining walls of the recessed areas 26 in the design of die plate 20 and as shown in detail for instance in FIG. 14, with such deformed bottom wall areas 66 projecting in smooth curvatures into the respective underlying recessed areas 64 in die plate 60, but however, without "bottoming out" in the recessed areas 64 of die plate 60.

The purpose of such deformation of the bottom defining surfaces 66 of the recessed areas 26 in die plate 20 are to increase the depth of the recesses and thus increase the roundness and extent of the embossments on the paper stock material during production of the product via the process illustrated in FIGS. 6, 7, 10, 11 and 15. The distorted wall die and associated produced counter from such distorted wall die additionally provide multi-level embossment areas in the stock material or work sheet upon completion of the simultaneous embossing and hot stamping operation due to the fact that certain of the raised areas 30 in the die design (FIG. 14) are likewise distorted downwardly upon application of the press pressure to the die; such downwardly distorted areas 30 not only cause embossment of the paper stock material, but also operate to still cause transfer of the heat transferable material to the paper stock. Therefore for this modified die plate, transfer of foil occurs in the areas of embossment resulting from the downwardly distorted areas 30, but does not occur in the recess areas 26 of the die. Transfer of foil also of course occurs in the non-downwardly distorted areas of the die. In other respects, the FIGS. 12 through 14 modification is generally similar to that aforedescribed in connection with the first described embodiment.

While copper plate has been identified as being the material forming the die plates, it will be understood that other suitable materials could be utilized also. Also, while the pattern sheet has been described as being copper sheet of approximately 0.005 of an inch thickness, it will be understood that there are other materials which could likewise be utilized, such as for instance aluminum sheet, but with copper sheet being preferred since its deformability characteristics for the instant purposes exceed that of aluminum.

From the foregoing description and accompanying drawings, it will be seen that the invention provides a novel method and apparatus for simultaneously embossing and hot stamping sheet-like stock material, such as for instance greeting card stock, with the apparatus comprising a die and means to transmit heat to the die, with the die including a selected relief design thereon, including recessed areas and raised areas, and with the apparatus including a counter for the die, with the counter including projecting areas conforming in general to said recessed areas, of the die, but when disposed in closed condition with the die, having predetermined spacing between said projecting areas of the counter and said recessed areas of the die, and with the die and coacting counter being adapted to receive therebetween a flexible substrate having heat transferable material thereon, with the apparatus including means for supporting the die and the counter in general confronting relation and operable for causing relative compressive movement therebetween, for causing embossment of the design of the recessed areas of the die into intermediate arranged stock material, and simultaneously causing transfer of the heat transferable material from the substrate at the die raised areas onto the stock material, while generally preventing or selectively localizing transfer of the heat transferable material on the flexible substrate to the embossed areas of the stock material.

The invention also provides a method and apparatus for simultaneously embossing and hot stamping sheet-like stock material wherein the die is formed by a conventional photographic transfer and etching processes, utilizing a photographic negative of the produced artist's design, for transfer to the die plate, but wherein such negative of the artist's design is reduced in size resulting in a reduction in the size of the relief design produced on the die plate to expeditiously compensate for distortion of the paper stock material during subsequent embossment of the paper stock material by the die plate and associated counter.

The invention also provides a novel method of simultaneously embossing and hot stamping sheet-like stock material utilizing a die and associated coacting counter, and eliminating registration problems between the embossed areas and the hot stamped areas on the produced design.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

We claim:

1. Apparatus for simultaneously embossing predetermined areas of sheet-like stock material and hot stamping selected portions only of embossed and/or non-embossed areas of said stock material comprising, a die, means to transmit heat to said die, said die including a relief design thereon including recesses areas and raised areas, a counter for said die, said counter including projecting areas conforming in general to said recessed areas of said die, but so constructed and arranged that there exists spacing between said counter projecting areas and said die recessed areas in a coacting closed condition of said die and said counter, a flexible substrate having heat transferable material thereon, adapted to be disposed between said die and said counter, means to support said die and said counter in generally confronting relation and operable to cause relative compressive movement therebetween to said coating closed condition for embossing the design of said recessed areas of said die and coating projecting areas of said counter into intermediately oriented stock material and to cause transfer of said heat transferable material from the substrate at said die design raised areas onto the stock material, while preventing or selectively localizing transfer of the heat transferable material on said substrate to the embossed areas of the stock material, and wherein said die comprises a plate-like member comprising top and bottom surfaces with said design being formed into one of said surfaces, with the other surface being deformed outwardly in the vicinity of at least some of said recessed areas to increase the depth of the latter, thus enhancing the degree of said embossing of said stock material during said relative compressive movement between said die and said counter.

2. Apparatus in accordance with claim 1 wherein said design on said die is a photographic transfer and etching design onto a metal plate comprising said die plate-like member.

3. Apparatus in accordance with claim 2 wherein an artist's original rendition of the design which is photographed for transfer of the artist's rendition to said plate preparatory to etching said artist's rendition into said plate, is a photographically reduced size rendition of said design prior to transfer to said plate, whereby the size of the resultant design rendition on said plate is smaller than the size of the artist's original rendition.

4. Apparatus in accordance with claim 2 in combination with photographic means for transferring a design from an artist's rendition thereof to said plate including means for reducing the size of the photographic image of the artist's rendition, prior to transfer of said reduced size image to said plate, said counter being of a reduced size relief image as produced from said die plate.

5. Apparatus in accordance with claim 1 wherein said counter comprises thermosetting resinous material.

6. Apparatus in accordance with claim 1 wherein said die plate-like member comprises copper plate.

7. Apparatus in accordance with claim 1 wherein said apparatus includes heating means capable of providing a temperature within a range of approximately 150° F. to 300° F., and means for selectively controlling the temperature within said range for transmitting predetermined heat to said flexible substrate and associated heat transferable material thereon.

8. Apparatus in accordance with claim 1 including a deformed pattern sheet produced from said relief die design on said die, in a press, with predetermined pressure, to form the design defined by the last mentioned die design onto said sheet, said sheet providing means for the production of said counter.

9. Apparatus in accordance with claim 8 including a press having a resilient pad for the production of the said design on said sheet for forcing said sheet into said recessed areas of said relief design on said die and thus producing a smoothly contoured design reproduction of said recessed areas of said die design, on said sheet.

10. A method for simultaneously embossing predetermined areas of a workpiece of sheet-like stock material and hot stamping selected portions only of embossed and/or non-embossed areas of said stock material comprising, providing a die and means to heat said die to a predetermined temperature, said die having a relief design thereon including recessed areas and adjacent raised areas, providing a counter for said die with said counter including projections conforming in general to said recessed areas of said die, but so constructed and arranged that there exists spacing between the counter projecting areas and the die recessed areas in a coacting closed condition of the die and counter, inserting a flexible substrate having heat transferable material thereon between said die and said counter together with stock material, moving said die and counter relatively toward one another to cause compression of said stock material and said substrate between said die and said counter and transfer of said heat transferable material from said substrate at said die design raised areas onto the stock material and generally simultaneous embossment of said counter projections into confronting areas of said stock material while precluding or selectively limiting transfer of the heat transferable material on said flexible substrate to said embossed areas of said stock material.

11. A method in accordance with claim 10 wherein said compressive movement of said counter and die relative to one another to cause compression of said stock material and said substrate therebetween is applied at a pressure within a range of 100 psi to 500 psi.

12. A method in accordance with claim 10 including providing means for aligning said counter and said die relative to one another prior to accomplishing said relative movement and said compression thereof.

13. A method in accordance with claim 10 including heating said die within a range of approximately 150° F. to 300° F. prior to causing said compressive movement of said die and counter relative to one another, for accomplishing said transfer of said heat transferable material from said substrate to said stock material.

14. A method in accordance with claim 10 including the printing of a design on said stock material prior to placing said stock material between said counter and said die, and then aligning said printed design on said stock material with the relief design on said die prior to said simultaneous embossing and hot stamping.

15. A method in accordance with claim 14 wherein said printing is accomplished in colors on said stock material, and including taking the artist's original rendition of said design and photographically reducing it in size a predetermined amount prior to the transfer thereof to a metal plate comprising said die whereby the resultant design rendition on said die plate is smaller than the size of the artist's design rendition as printed on the stock material, and then forming said counter from the reduced size design rendition on said plate, and wherein said transfer of said heat transferable material from said substrate to said stock material occurs at the peripheral edges of said printing, which are likewise the general peripheral edges of at least some of the embodiments on said stock material.

16. A method in accordance with claim 10 wherein said substrate comprises a synthetic resin backing sheet supporting a pigment composition including a metallic constituent and binding agent therefor.

17. A method in accordance with claim 10 wherein a pressure within a range of approximately 100 psi to 500 psi is applied to said die and counter and at a temperature within a range of approximately 175° F. to 200° F., to cause transference of said transferable material from said substrate to said stock material.

18. A method in accordance with claim 10 wherein said relief design on said die is formed by photographic transfer and etching of said design onto a metal plate comprising said die.

19. A method for simultaneously embossing and hot stamping a workpiece of sheet-like stock material comprising providing a die means to heat said die to a predetermined temperature, said die having a relief design thereon including recessed areas and adjacent raised areas, providing a counter for said die with said counter including projections conforming in general to said recessed areas of said die but so constructed and arranged that there exists spacing between the counter projecting areas and the die recessed areas in a coacting closed condition of the die and counter, inserting a flexible substrate having heat transferable material thereon between said die and said counter together with stock material, moving said die and counter relatively toward one another to cause compression of said stock material and said substrate between said die and said counter and transfer of said heat transferable material from said substrate at said die design raised areas onto the stock material and embossment of said counter projections into said stock material while precluding or selectively limiting transfer of the heat transferable material on said flexible substrate to said embossed areas of said stock material, and including the step of applying predetermined pressure to said die having said three-dimensional relief design thereon to cause by distortion increased depth of said recessed areas of said relief design, whereby the subsequent embossment of said stock at said recessed areas of said relief design is enhanced during compressive movement of said die and said counter relative to one another.

20. A method in accordance with claim 19 wherein said application of predetermined pressure to said die and associated relief design is in the range of approximately 2,800 to 3,000 psi.

21. Apparatus for simultaneously embossing and hot stamping sheet-like stock material comprising a die, means to transmit heat to said die, said die including a relief design thereon including recessed areas and raised areas, a counter for said die, said counter including projecting areas conforming in general to said recessed areas of said die, but so constructed and arranged that there exists spacing between said counter projecting areas and said die recessed areas in a coacting closed condition of said die and said counter, a flexible substrate having heat transferable material thereon, adapted to be disposed between said die and said counter, means to support said die and said counter in generally confronting relation and operable to cause relative compressive movement therebetween to said coacting closed condition for embossing the design of said recessed areas of said die into intermediately oriented stock material and to cause transfer of said heat transferable material from the substrate at said die design raised areas onto the stock material, while preventing or selectively localizing transfer of the heat transferable material on said substrate to the embossed areas of the stock material, and wherein said die comprises a platelike member comprising top and bottom surfaces with said design being etched into one of said surfaces, with the other surface being deformed outwardly in the vicinity of said recessed areas to increase the depth of the latter, thus enhancing the degree of said embossing of said stock material during said relative compressive movement between said die and said counter.

22. A method of making an embossing and hot stamping die utilizable in simultaneous embossing and hot stamping of stock material in a press, comprising the steps of photographing an artist's design to be used, reducing the size of the photographic negative of said design in the order of 1% to 2%; using said reduced size negative of said design for transfer of the latter to a die plate and etching said reduced size design into the surface of said die plate, so that the etched relief design in said die plate is of reduced size in transverse dimension as compared to the size of the artist's original design, and then using said die plate and a malleable pattern sheet to mechanically produce a forming mold corresponding to the design in said die plate, and producing a counter from said forming mold, said forming mold and produced counter being so constructed and arranged that there exists spacing between projections on said counter and complementary recessed areas in said die plate design upon closing of said counter and die plate in conjunction with predetermined pressure and temperature, said projections on said counter when coacting with said recesses in said die plate during said closing causing said embossment of the stock material.

23. A method in accordance with claim 22 including applying predetermined pressure to said relief design in said die plate to cause downward distortion of said relief design and increased depth of recessed areas in said die plate design, prior to said using said die plate and a malleable pattern sheet to mechanically produce a forming mold.

* * * * *